US008368560B2

(12) United States Patent
McDonald

(10) Patent No.: US 8,368,560 B2
(45) Date of Patent: Feb. 5, 2013

(54) AUTOMATED WARNING SYSTEM FOR WATERSKI BOATS

(76) Inventor: Walter Dea McDonald, Mesa, AZ (US)

( * ) Notice: Subject to any disclaimer, the term of this patent is extended or adjusted under 35 U.S.C. 154(b) by 493 days.

(21) Appl. No.: 12/653,291

(22) Filed: Dec. 11, 2009

(65) Prior Publication Data

US 2011/0140925 A1 Jun. 16, 2011

(51) Int. Cl.
*G08B 23/00* (2006.01)

(52) U.S. Cl. ..... 340/984; 340/988; 340/989; 340/932.2; 340/468; 340/471; 340/472; 340/485; 340/539.32

(58) Field of Classification Search ..... 340/984, 340/988, 989, 932.2, 468, 471, 472, 485, 340/539.32
See application file for complete search history.

(56) References Cited

U.S. PATENT DOCUMENTS

| | | | | |
|---|---|---|---|---|
| 2,324,614 | A | | 7/1943 | Dalton |
| 2,579,292 | A | | 12/1951 | Brelsford |
| 3,021,513 | A | | 2/1962 | Lankey |
| 3,103,005 | A | | 9/1963 | Hills |
| 3,171,988 | A | | 3/1965 | Donahue |
| 3,540,406 | A | | 11/1970 | Dexter |
| 3,540,685 | A | | 11/1970 | Gualano |
| 3,602,188 | A | | 8/1971 | Penaflor |
| 3,675,616 | A | | 7/1972 | McInnis |
| 3,722,841 | A | | 3/1973 | Ciolfi |
| 3,735,724 | A | | 5/1973 | Miller |
| 3,786,778 | A | | 1/1974 | Palmer et al. |
| 3,797,450 | A | | 3/1974 | Frisbee |
| 3,798,631 | A | | 3/1974 | Langford |
| 3,802,112 | A | | 4/1974 | Banner |
| 3,941,340 | A | | 3/1976 | Rankins |
| 3,952,981 | A | | 4/1976 | Acker |
| 3,996,882 | A | | 12/1976 | Martin et al. |
| 4,090,468 | A | | 5/1978 | D'Spain |
| 4,122,796 | A | | 10/1978 | Pressler et al. |
| 4,435,701 | A | * | 3/1984 | Baon ..... 340/546 |
| 4,483,683 | A | | 11/1984 | Alley, Sr. |
| 4,545,320 | A | | 10/1985 | Lewis et al. |
| 4,599,965 | A | | 7/1986 | Johnson |
| 4,624,141 | A | | 11/1986 | Soleau |
| 4,640,213 | A | | 2/1987 | Lugo |
| 4,689,611 | A | | 8/1987 | Franklin |
| 4,782,784 | A | | 11/1988 | Little |
| 4,807,557 | A | | 2/1989 | Lodisio |
| 4,813,369 | A | | 3/1989 | Moreland |
| D301,697 | S | | 6/1989 | Morris |
| 4,871,996 | A | | 10/1989 | Tsunamoto et al. |
| 4,934,972 | A | | 6/1990 | Shumway et al. |
| D310,185 | S | | 8/1990 | Tick |
| 4,962,720 | A | | 10/1990 | Leffel |
| 4,977,849 | A | | 12/1990 | Brinton |
| 5,024,179 | A | | 6/1991 | Leffel |
| 5,038,136 | A | | 8/1991 | Watson |
| 5,042,418 | A | | 8/1991 | Hoover et al. |
| 5,304,993 | A | | 4/1994 | Handsaker |
| 5,329,873 | A | | 7/1994 | Tiballi |
| 5,408,221 | A | | 4/1995 | Carsella, Sr. et al. |
| D362,199 | S | | 9/1995 | Evans |
| 5,483,916 | A | | 1/1996 | Kolvites et al. |

(Continued)

*Primary Examiner* — Tai T Nguyen
(74) *Attorney, Agent, or Firm* — Ballard Spahr LLP

(57) ABSTRACT

There is provided an automated warning system which includes a receiver/controller, an actuator, one or more relays electrically connected to both the receiver and the linear actuator, a flag holder and a mechanical linkage connecting the linear actuator to the flag holder such that movement of the linear actuator causes the flag holder to move between raised and lowered positions.

20 Claims, 5 Drawing Sheets

U.S. PATENT DOCUMENTS 5,550,531 A 8/1996 Little-Lowry
5,771,836 A 6/1998 Crouse
5,933,081 A * 8/1999 Jones ..... 340/539.32
5,961,087 A 10/1999 Lee
6,057,787 A 5/2000 Kell et al.
6,085,687 A 7/2000 Chester
6,250,248 B1 6/2001 Patera
6,337,623 B1 1/2002 Krugh, IV et al.
6,481,366 B1 11/2002 Patera
6,580,368 B1 * 6/2003 Jacobs ..... 340/539.11
6,584,927 B1 7/2003 Iversen et al.
6,748,683 B1 6/2004 Schultz
6,962,126 B1 11/2005 Payson
7,013,823 B1 3/2006 Daugherty
7,059,264 B1 6/2006 Hall et al.
7,059,690 B1 6/2006 Pinkston
7,109,871 B2 9/2006 Lentine et al.
7,119,679 B1 * 10/2006 Crom ..... 340/539.32
7,370,599 B1 5/2008 Berman et al.
7,385,526 B1 * 6/2008 Bullard et al. ..... 340/932.2
7,396,268 B2 7/2008 Hyjek
7,428,879 B1 9/2008 White et al.
7,513,467 B1 4/2009 Hurley
7,546,815 B2 6/2009 Mazzei et al.
2008/0035049 A1 2/2008 Johnston et al.
2008/0061968 A1 * 3/2008 Hollimon ..... 340/539.32

* cited by examiner

AUTOMATED WARNING SYSTEM FOR WATERSKI BOATS

FIELD

This application relates to boating equipment and safety equipment for boats and individuals engaged in water sports.

BACKGROUND

Many states require that boats towing waterskiers employ a brightly colored flag to alert nearby boats to the presence of the skier and/or ski rope. Beginning at the time the skier and/or the ski rope are in the water, the flag must be held in a raised position, visible to other boats, until either the skier is up on his or her skis, or the skier and/or rope are back inside the boat.

Many states further require that an observer other than the driver, located within the boat, be responsible for raising and lowering the flag. In addition to raising and lowering the flag, the observer often has other responsibilities including, but not limited to, assisting the skier in and out of the water, deploying and retrieving the ski rope, communicating the position and status of the skier to the driver, and ensuring the overall safety of the skier. Each of these responsibilities is time sensitive and must be coordinated with both the skier and the driver. As such, the observer often finds that manually deploying and constantly holding a ski flag in the raised position hinders his or her ability to perform the other responsibilities.

It should be understood that the same regulations generally apply equally to all water sports in which a person enters the water surrounding a watercraft including, but not limited to, wakeboarding, tubing, knee boarding and swimming.

In view of the foregoing there is a need for an observer-activated system for maintaining the flag in a visible or otherwise raised position while a person and/or a rope are in the water and maintaining the flag in a stowed or otherwise lowered position while the person is visibly atop the surface of the water or within the boat. The present invention addresses one or more of these needs.

SUMMARY

According to one embodiment a warning system includes a receiver/controller which receives a signal and in response activates an actuator via one or more relays. The actuator is connected to a flag holder via a mechanical linkage. Energizing the actuator causes a shaft of the actuator to retract and further causes the flag holder to move from a lowered position to a raised position. Later energizing the actuator causes the shaft to extend, further causing the flag holder to move from a raised position to a lowered position.

According to another embodiment, the mechanical linkage and flag holder are configured such that energizing the actuator causes the shaft of the actuator to retract and further causes the flag holder to move from a raised position to a lowered position. Later energizing the actuator causes the shaft to extend, further causing the flag holder to move from a lowered position to a raised position.

According to another embodiment, the warning system further includes a transmitter for transmitting one or more discrete signals to a receiver/controller.

According to a further embodiment, the warning system further includes an enclosure for surrounding components of the system.

According to yet another embodiment, the warning system includes a strobe light positioned atop the system.

Other independent features and advantages of the automated warning system will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding Background or Summary or the following Detailed Description. Reference will now be made in detail to exemplary embodiments, examples of which are illustrated in the accompanying drawings. Wherever possible, the same reference numbers will be used throughout the drawings to refer to the same or like parts.

Figure 1:
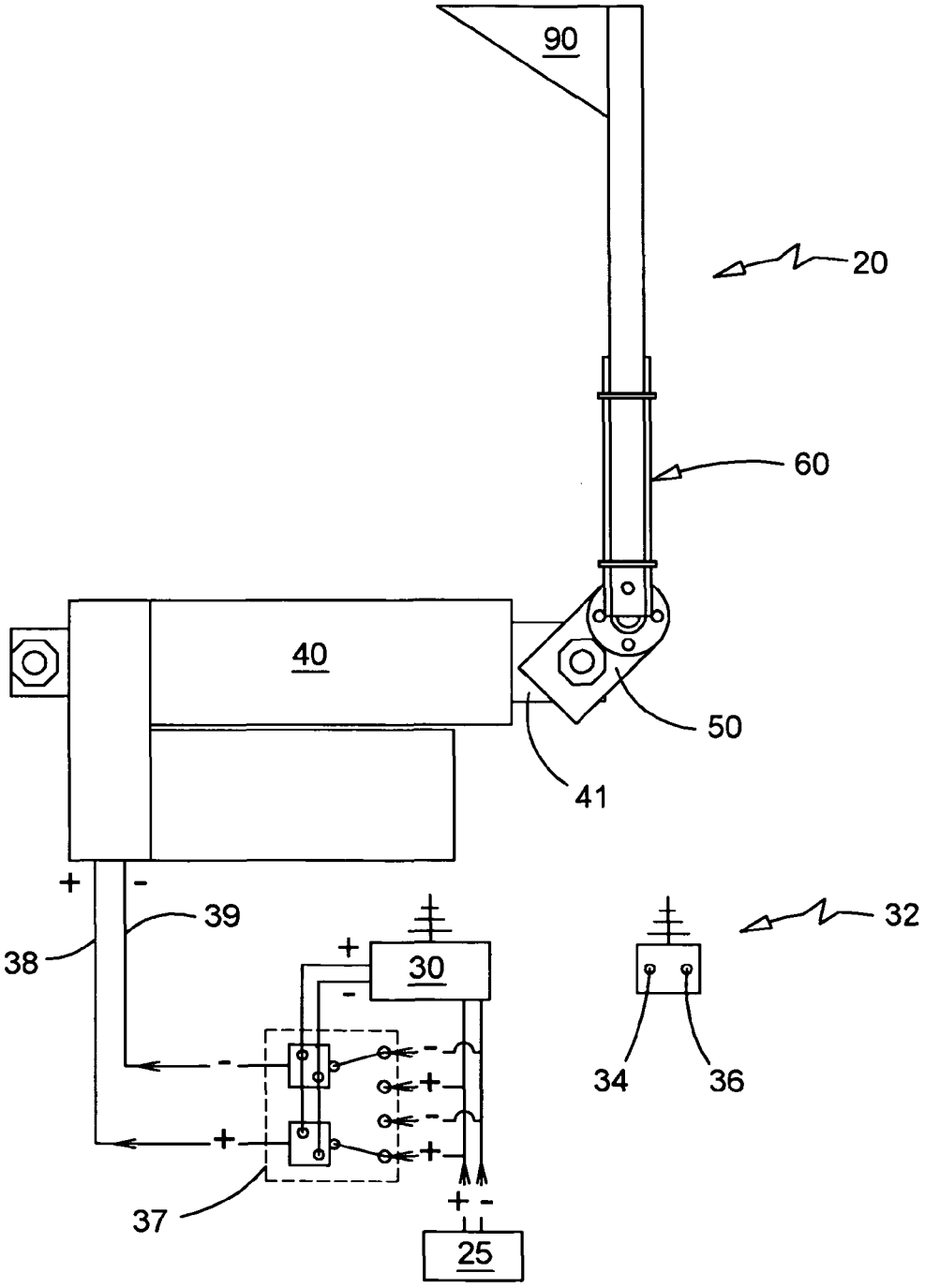
FIG. 1 is a schematic view of the automated warning system, according to one embodiment, wherein the flag holder is in a raised position.
Figure 2:
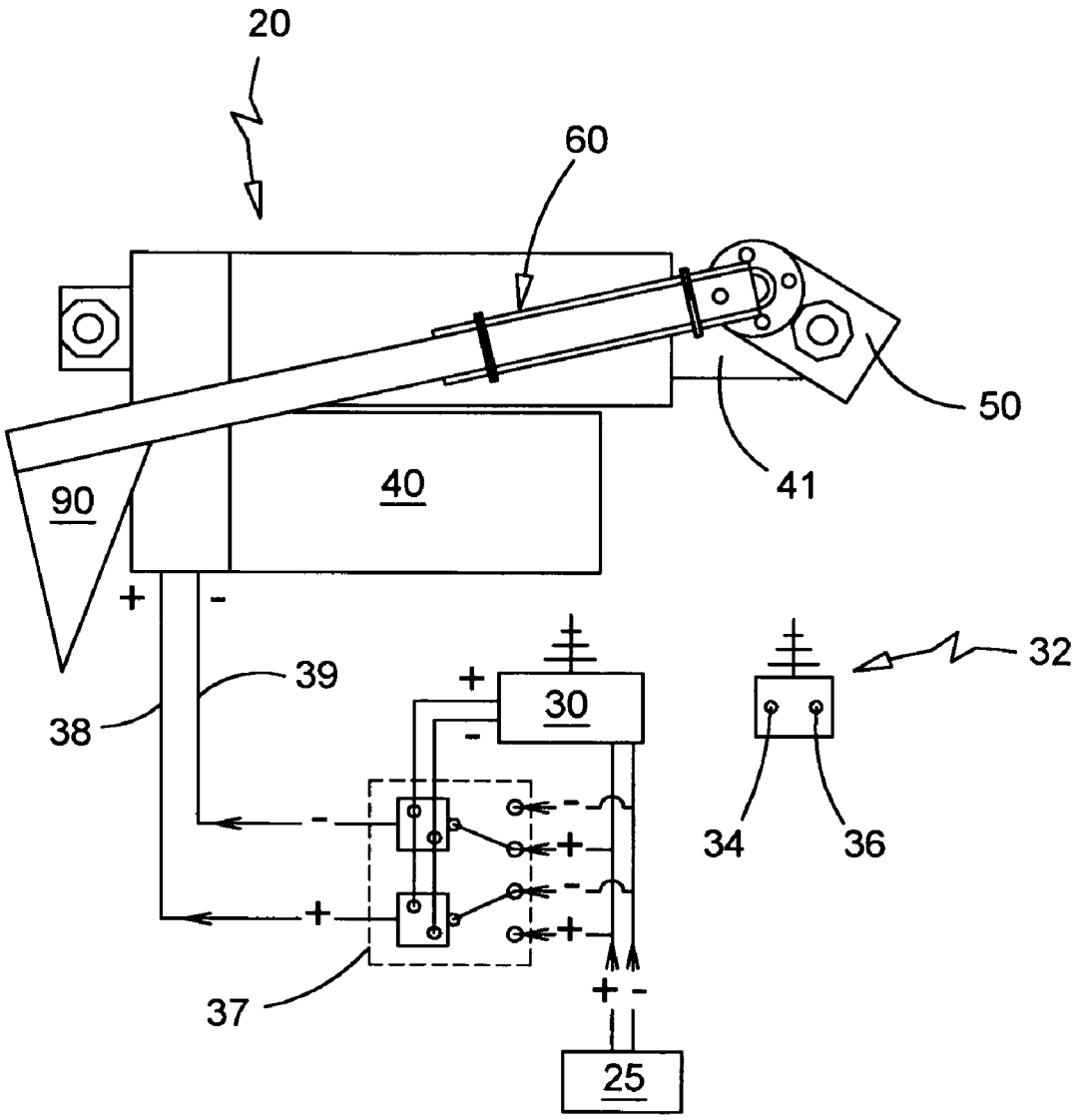
FIG. 2 is a further schematic view of the automated warning system, according to the embodiment of FIG. 1, wherein the flag holder is in a lowered position.

As shown in FIGS. 1 and 2, a warning system 20 has a receiver/controller 30, an actuator 40, a mechanical linkage 50, and a flag holder 60. The receiver/controller 30 is electrically connected to one or more relays 37 such that a control signal may be transmitted to the one or more relays by the receiver/controller 30. The one or more relays 37 are further electrically connected to the actuator 40 such that the one or more relays 37 may energize the actuator 40 as set forth more fully below. The actuator 40 is connected to the flag holder 60 by the mechanical linkage 50 such that the movement of a shaft 41 of the actuator 40 results in movement of the flag holder 60, and a flag 90, if attached.

The receiver/controller 30 may be any component designed to operate the one or more relays 37 to provide power to the actuator 40. Each relay 37 is preferably a latching relay such that the actuator 40 receives a constant positive or negative electrical signal rather than a pulse or momentary electrical signal. Further, each relay 37 is preferably a multiple pole multiple throw magnetic latching relay, however any relay 37 is within the inventive concept. The receiver/controller 30 and the one or more relays 37 may be separate components or they may be combined and treated as a single component. According to one embodiment, the receiver/controller 30 is a radio frequency receiver/controller 30 to receive a signal transmitted by a radio frequency transmitter 32. By way of example only, a 2 channel radio frequency transmitter and receiver board, such as the type manufactured by Annex Depot, Inc. (Model No. ERF-2A433-MT) is appropriate for use in this device.

The actuator 40 converts an electrical signal to physical movement, thereby causing the flag holder 60 to move between a lowered position and a raised position. For purposes of this Disclosure, the raised position is a generally vertical position, and the lowered position is any position at or below a generally horizontal position. The actuator 40 is preferably a linear actuator. Further, the linear actuator 40 is preferably a 12 volt direct current motor operated linear actuator, although any linear actuator 40 is within the inventive concept. According to one embodiment, the linear actuator 40 further includes a limit switch designed to prevent the shaft 41 of linear actuator 40 from moving more than a predetermined distance. According to one embodiment a preferred distance of extension and retraction is approximately one inch. Again, by way of example only, a one inch stroke, 12 volt direct current linear actuator manufactured by Firgelli Automations is sufficient for use in this device. Alternatively, a direct drive step motor or a motor operated gear box with indirect drive may be used in place of linear actuator 40 to convert the electrical signal into physical movement.

Figure 4:
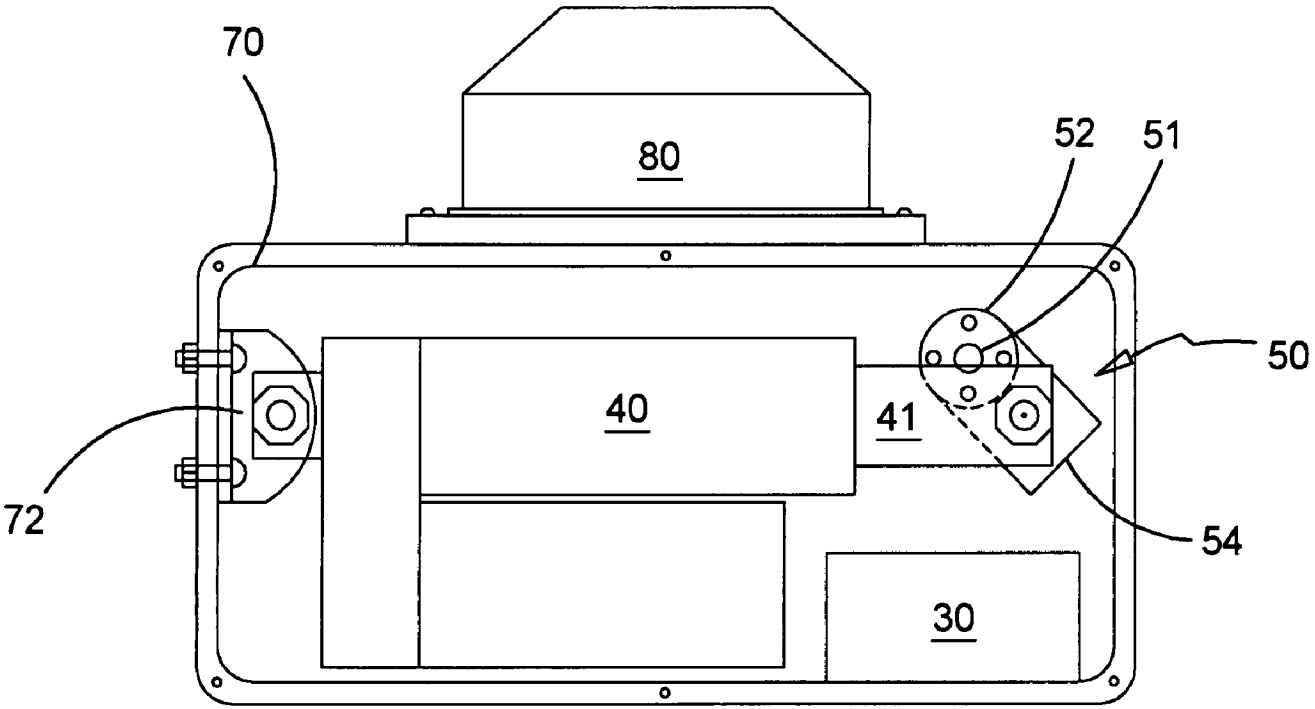
FIG. 4 is a cutaway view of the automated warning system according to one embodiment.
Figure 5A:
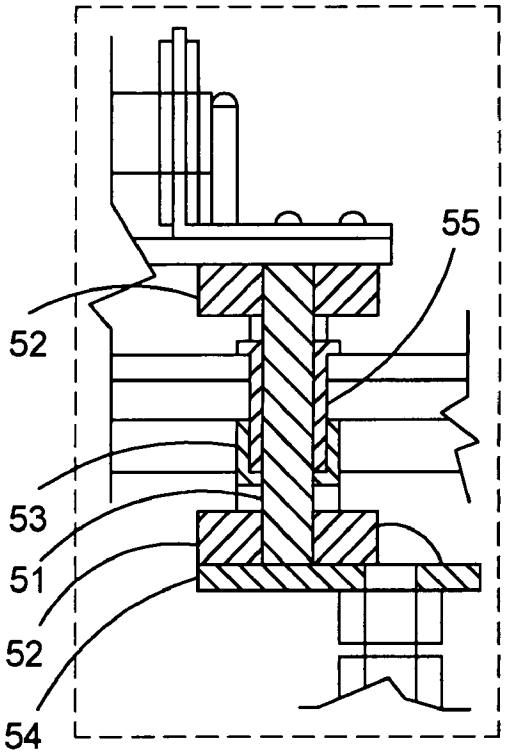
FIG. 5 is top cutaway view of the automated warning system according to one embodiment.
Figure 5:
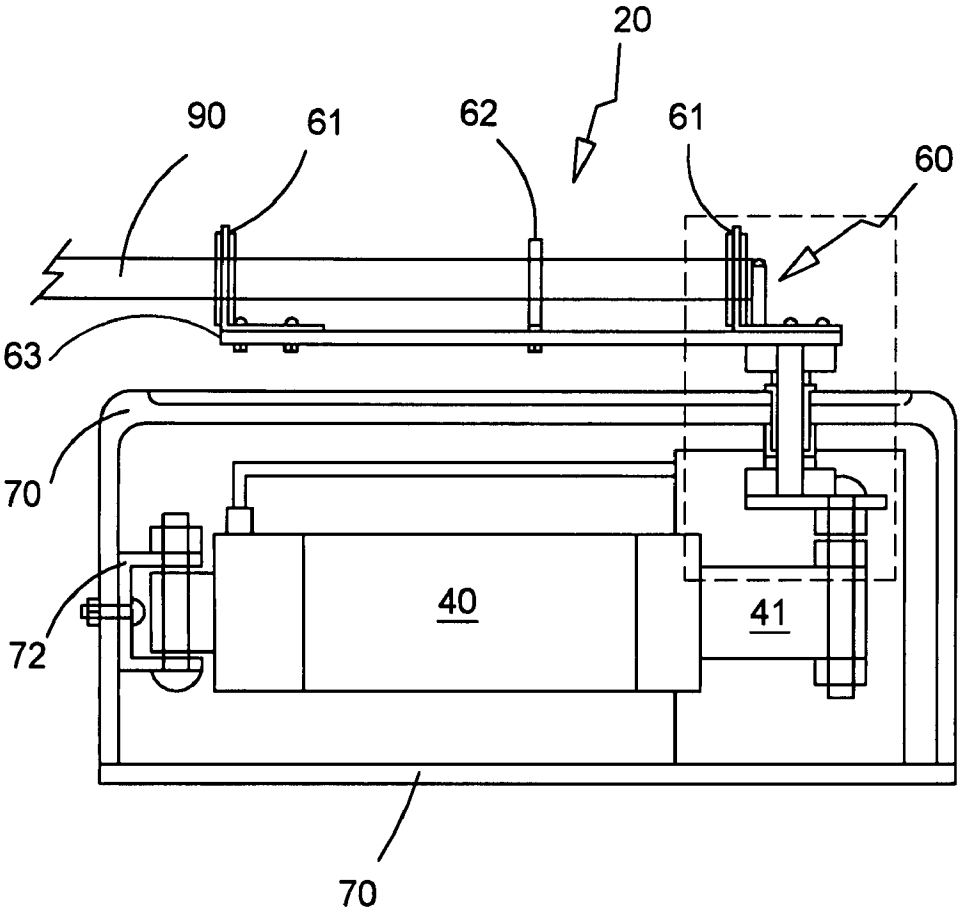

The mechanical linkage 50 is secured to the shaft 41 of the linear actuator 40 and to the flag holder 60. The mechanical linkage 50 can be any assembly that effectively connects the linear actuator 40 to the flag holder 60. According to one embodiment, as shown in FIGS. 4 and 5, the mechanical linkage 50 is made up of an axle 51, at least two set-screw hubs 52, one set-screw collar 53, one linkage armature 54 and a bushing 55. Alternatively, for example, the mechanical linkage 50 may consist of at least two die-cast aluminum armatures mounted on one stainless steel axle and bushing with two set screws.

The flag holder 60 may be any device capable of grasping, retaining and supporting the flag 90. The flag holder 60 may be a device that allows the flag 90 to be attached to and detached from the device without permanent fasteners. According to one embodiment, for example, the flag holder 60 is a quick release device which consists of two rubber lined flag pole supports 61 and a spring loaded friction clip 62, each secured to a flag armature 63. Alternatively, the flag holder 60 may be a device that permanently secures the flag 90.

According to another embodiment, the warning system 20 further has an enclosure 70. The enclosure 70 is preferably of plastic or metal, but may be anything that adequately encloses various components of the invention. According to one embodiment, as shown in FIG. 4, the enclosure 70 consists of a compartment for containing the linear actuator 40, the receiver/controller 30, and the one or more relays 37. According to another embodiment (not pictured), the enclosure 70 may further enclose a power supply 25. According to the embodiment of FIG. 3, the flag holder 60 is preferably located on the exterior of the enclosure 70. The flag holder 60 is held in place by mechanical linkage 50, which is located partially interior and partially exterior to the enclosure 70. Specifically, the axle 51, which connects the linkage armature 54, located within the enclosure 70, and the flag armature 63, located outside the enclosure 70, extends through the wall of the enclosure 70. Some implementations of the warning system 20 may further require that the enclosure 70 is moisture resistant. Further, as shown in FIG. 4, the linear actuator 40 may be secured to the enclosure 70 with an actuator pivot bracket 72.

Figure 3:
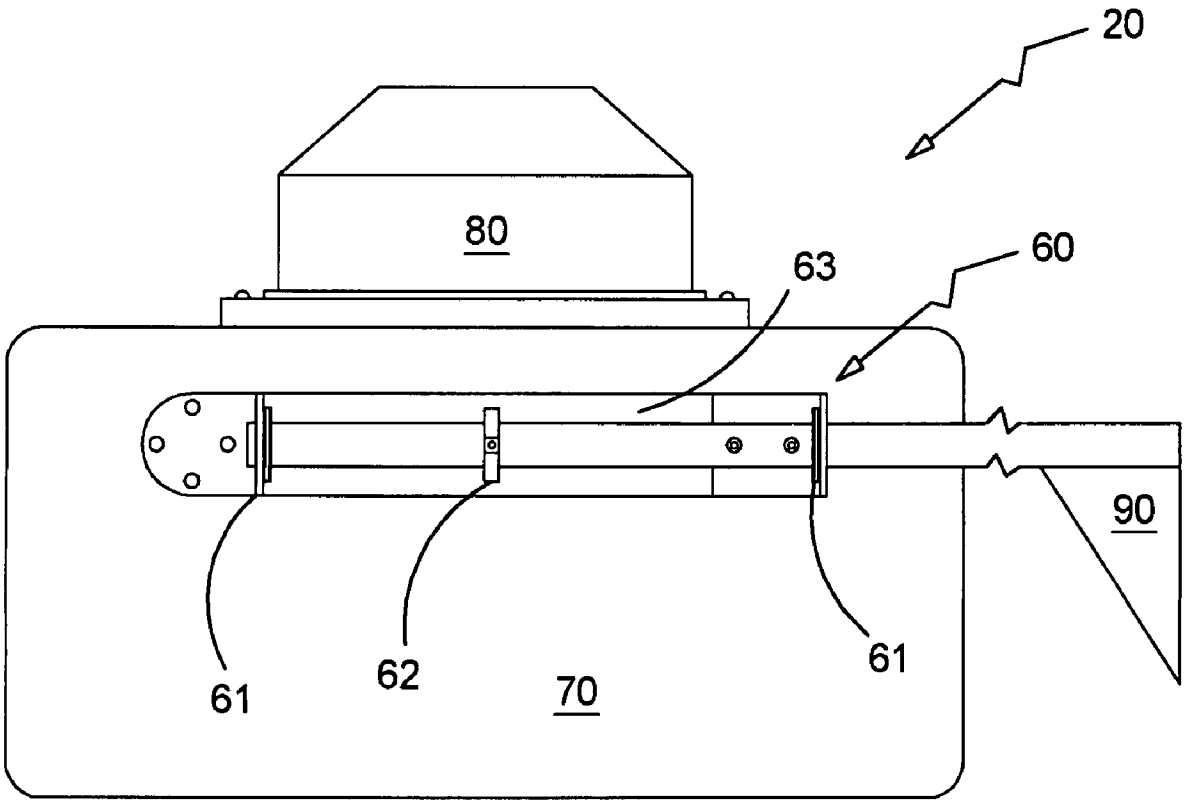
FIG. 3 is a front view of the automated warning system according to one embodiment.

As shown in FIGS. 3 and 4, the warning system 20 may further include a light 80 designed to serve as an additional method of alert to surrounding watercraft. The light 80 is preferably a strobe light, although any light is within the inventive concept. The light 80 is preferably affixed to the top of the warning system 20 such that it is most visible to surrounding watercraft.

Referring again to FIG. 1, while in use, power is supplied to the linear actuator 40 and the receiver/controller 30. When the user desires to raise the flag, the user sends a first signal by pressing a first button 34 on the transmitter 32. The transmitter 32 will transmit a discrete signal to the receiver/controller 30. The receiver/controller 30 will then send an electrical signal to the relay 37 to apply a positive voltage on a first wire 38 of the linear actuator 40 and apply a negative voltage on a second wire 39 of the linear actuator 40. The positive and negative circuits will energize the linear actuator 40, causing the shaft 41 of the linear actuator 40 to retract. At a retraction of a preset length, a limit switch within the linear actuator 40 will deenergize the linear actuator 40. The retraction of the shaft 41 causes the mechanical linkage 50 to rotate the flag holder 60 and the flag from a lowered position to a raised position.

According to another embodiment, the positive and negative circuits from the relay 37 also energize the light 80.

When the user desires to lower the flag, the user sends a second signal by pressing a second button 36 on the transmitter 32. The transmitter 32 will transmit a discrete signal to the receiver/controller 30. As shown in FIG. 2, the receiver/controller 30 will send an electrical signal to the relay 37 to apply a negative voltage on the first wire 38 of linear actuator 40 and apply a positive voltage on the second wire 39 of linear actuator 40. The reversed positive and negative polarity circuits will energize the linear actuator 40 and the shaft 41 will extend. At an extension of a preset length, a limit switch within the linear actuator 40 will deenergize the linear actuator 40. The extension of the shaft 41 causes the mechanical linkage 50 to rotate the flag holder 60 and flag from a raised position to a lowered position.

According to another embodiment, the reversed polarity of the relay 37 also deenergizes the light 80.

According to yet another embodiment, but by the same general principles, the mechanical linkage 50 and flag holder 60 are configured such that energizing the linear actuator 40 causes the shaft 41 of the linear actuator 40 to retract and further causes the flag holder 60 to move from a raised position to a lowered position. Later energizing the linear actuator 40 causes the shaft 41 to extend, further causing the flag holder 60 to move from a lowered position to a raised position.

The disclosed embodiments provide advantages over the prior art. For example, the disclosed embodiments allow one or more observers to assist the skier in and out of the water and deploy and retrieve the ski rope, among other things, while ensuring that the flag is maintained in a raised and preferably visible position. More importantly, the disclosed embodiment allows the user to comply with state law, which requires that an observer control the raising and lowering of the warning flag and not the driver, skier or an unmanned electrical and/or mechanical device.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to a particular embodiment disclosed as the best mode contemplated for carrying out this invention, but that the invention will include all embodiments falling within the scope of the appended claims.

The invention claimed is:

1. An automated warning system, comprising a linear actuator having a motor operated shaft and a limit switch, the motor operated shaft of the linear actuator being configured for linear extension and retraction, the limit switch being configured to monitor and control the extension and retraction of the linear actuator;

one or more relays connected in power delivery relation to the linear actuator, the one or more relays being in operative electrical communication with the limit switch of the linear actuator;

a receiver/controller connected in controlling relation to the one or more relays;

a flag holder; and a mechanical linkage coupled to and positioned between the flag holder and the actuator, wherein the mechanical linkage is coupled to the flag holder and the linear actuator such that linear movement of the linear actuator effects a corresponding movement of the flag holder about and between a lowered position and a raised position, wherein the raised position of the flag holder corresponds to movement of the linear actuator by a first preset length, and wherein, upon movement of the linear actuator by the first preset length, the limit switch is configured to deenergize the one or more relays.

2. The automated warning system according to claim 1, further comprising an enclosure, wherein the linear actuator, the one or more relays, and the receiver/controller are positioned within the enclosure.

3. The automated warning system according to claim 2, wherein the enclosure is moisture resistant.

4. The warning system according to claim 2, wherein the enclosure comprises at least one of plastic and metal.

5. The automated warning system according to claim 1, further comprising a light positioned in operative electrical communication with the one or more relays.

6. The automated warning system according to claim 5, wherein the light is a strobe light.

7. The automated warning system according to claim 1, further comprising a transmitter configured to transmit to the receiver/controller one or more signals indicative of a desired position of the flag holder.

8. The automated warning system according to claim 7, wherein the receiver/controller comprises a radio frequency receiver, and wherein the transmitter is a radio frequency transmitter.

9. The automated warning system according to claim 1, wherein the one or more relays are latching relays, and wherein the one or more relays are configured to apply a constant electrical signal until they are deenergized by the limit switch of the linear actuator.

10. The automated warning system according to claim 1, wherein the raised position of the flag holder corresponds to retraction of the linear actuator by the first preset length, wherein the lowered position of the flag holder corresponds to an extension of the linear actuator by a second preset length, and wherein, upon extension of the linear actuator by the second preset length, the limit switch is configured to deenergize the linear actuator.

11. An automated warning system, comprising:

a first means for receiving input from the user;

a second means for converting the user input to an electrical signal;

a third means for converting the electrical signal to linear motion;

a fourth means for supporting a flag in both raised and lowered positions;

a means for operatively connecting the third means and the fourth means, whereby the motion created by the third means causes the fourth means to move about and between said raised and lowered positions; and a means for deenergizing the third means upon positioning of the fourth means in at least one of the raised position and the lowered position.

12. An automated warning system according to claim 11, wherein the third means for converting the electrical signal to linear motion comprises a motor operated linear actuator.

13. An automated warning system, comprising:

a radio frequency transmitter;

a radio frequency receiver/controller, the radio frequency receiver/controller being configured to receive signals transmitted by the radio frequency transmitter;

a motor operated linear actuator having a shaft and a limit switch, the shaft of the linear actuator being configured for linear extension and retraction, the limit switch being configured to monitor and control the extension and retraction of the linear actuator;

a double pole double throw magnetic latching relay, the latching relay being operatively electrically coupled to the radio frequency receiver/controller, the motor operated linear actuator, and the limit switch of the motor operated linear actuator;

a flag holder; and a mechanical linkage operatively coupling the flag holder to the actuator, wherein the mechanical linkage is coupled to the flag holder and the linear actuator such that linear movement of the linear actuator effects a corresponding movement of the flag holder about and between a lowered position and a raised position, wherein the raised position of the flag holder corresponds to a movement of the linear actuator by a first preset length, wherein, upon movement of the linear actuator by the first preset length, the limit switch is configured to deenergize the one or more relays, and wherein the radio frequency transmitter is configured to transmit one or more signals indicative of a desired position of the flag holder.

14. An automated warning system according to claim 13, wherein the latching relay is configured to apply a constant electrical signal until it is deenergized by the limit switch of the linear actuator.

15. An automated warning system according to claim 13, wherein the raised position of the flag holder corresponds to retraction of the linear actuator by the first preset length, wherein the lowered position of the flag holder corresponds to an extension of the linear actuator by a second preset length, and wherein, upon extension of the linear actuator by the second preset length, the limit switch is configured to deenergize the linear actuator.

16. An automated warning system according to claim 13, further comprising a moisture resistant enclosure, wherein the linear actuator, the latching relay, and the radio frequency receiver/controller are positioned within the moisture resistant enclosure.

17. A method for alerting nearby watercraft, comprising:

providing a system according to claim 1;

placing the system upon a watercraft in a location that is visible to surrounding watercraft;

using the system to raise and lower a flag.

18. A method of equipping a watercraft to alert other watercraft, comprising:

coupling a motor operated linear actuator to the flag holder by a mechanical linkage, the flag holder configured to hold a flag, the motor operated linear actuator having a shaft configured for linear extension and retraction;

positioning at least one relay in operative electrical communication with a power source and with the linear actuator;

positioning a receiver/controller in controlling relation with the at least one relay; and transmitting a first activating signal from the transmitter to the receiver/controller, the first activating signal being indicative of a first desired position of the flag holder;

in response to receipt of the first activating signal by the receiver/controller, selectively activating the at least one relay such that the shaft of the linear actuator effects movement of the flag holder toward the first desired position; and deenergizing the at least one relay upon movement of the shaft of the linear actuator by a first preset length.

19. A method according to claim 18, further comprising:

transmitting a second activating signal from the transmitter to the receiver/controller, the second activating signal being indicative of a second desired position of the flag holder;

in response to receipt of the second activating signal by the receiver/controller, selectively activating the at least one relay such that the shaft of the linear actuator effects movement of the flag holder toward the second desired position; and deenergizing the at least one relay upon movement of the shaft of the linear actuator by a second preset length.

20. A method according to claim 19, wherein the first desired position is a raised position of the flag holder, wherein the second desired position is a lowered position of the flag holder, wherein the raised position of the flag holder corresponds to a retraction of the linear actuator by the first preset length, and wherein the lowered position of the flag holder corresponds to an extension of the linear actuator by the second preset length.

* * * * *